United States Patent [19]

Beer et al.

[11] 4,003,542

[45] Jan. 18, 1977

[54] FORM PANS FOR CONSTRUCTING RIBBED SLAB STRUCTURES

[76] Inventors: Issie M. Beer, 7514 Guelph Road, Cote St. Luc, Quebec; Zenon A. Zelinski, 3170 Place de Ramezay, Montreal, Quebec, Canada

[22] Filed: Sept. 22, 1975

[21] Appl. No.: 615,213

[52] U.S. Cl. ..... 249/31; 249/32; 249/175; 249/176; 249/177

[51] Int. Cl.[2] ..... E04G 11/40

[58] Field of Search ..... 249/29–32, 249/176–177, 183, 192–193, 212, 219 R; 52/756–757, 758 C

[56] References Cited

UNITED STATES PATENTS

| | | | |
|---|---|---|---|
| 1,289,069 | 12/1918 | Ambursen | 249/31 |
| 1,316,610 | 9/1919 | Zakharoff | 249/193 |
| 1,405,212 | 1/1922 | Hilton | 249/192 |
| 3,388,452 | 6/1968 | Connolly | 249/29 |
| 3,829,057 | 8/1974 | Fuchs | 249/183 |

*Primary Examiner*—Richard B. Lazarus
*Assistant Examiner*—John McQuade
*Attorney, Agent, or Firm*—Diller, Brown, Ramik & Wight

[57] ABSTRACT

The present invention encompasses a form pan for use in a form structure, the pan comprising a unitary shell having a top wall, opposed elongated side walls and end walls. A peripheral flange is formed about a free end of the side and end walls and defines a load supporting section and a connection section to permit interlocking with an adjacent pan and support of a load on the pans. The pans are of sufficient length to act as self supporting long beams to span spaced apart support beams which are normally held above a support surface by adjustable support posts.

20 Claims, 18 Drawing Figures

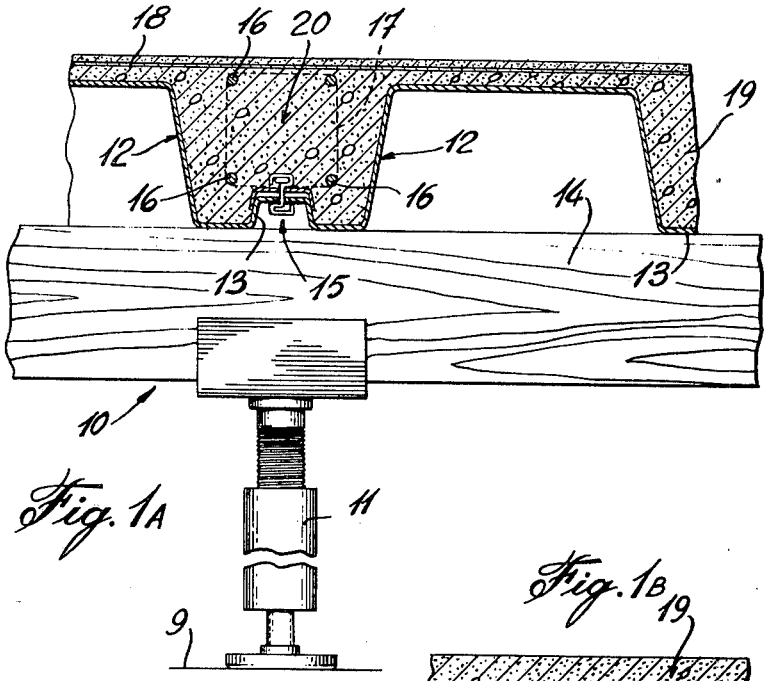
Fig. 1A
Fig. 1B
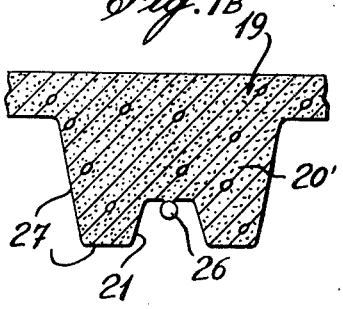
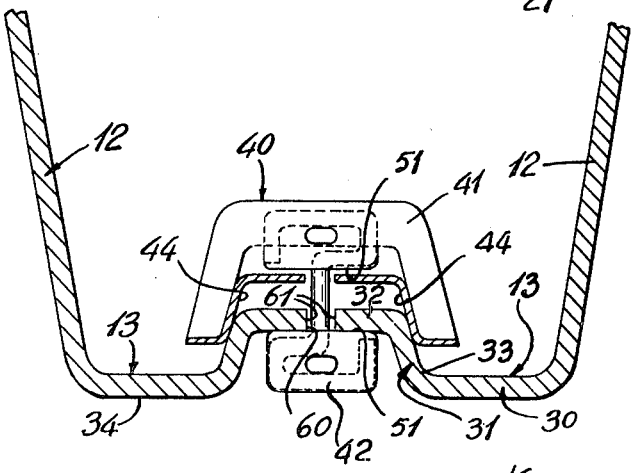
Fig. 3

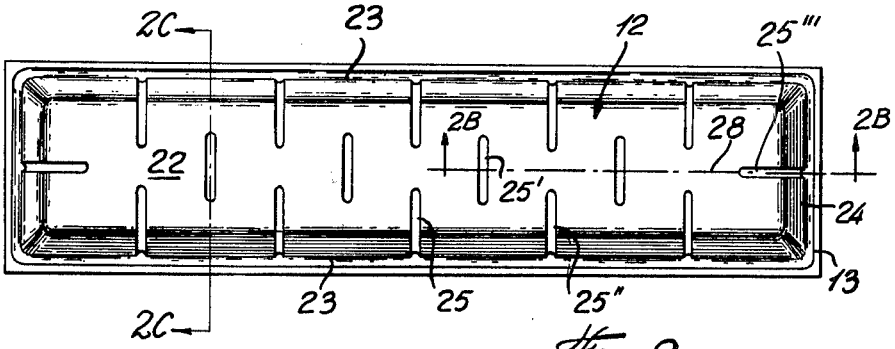
Fig. 2A
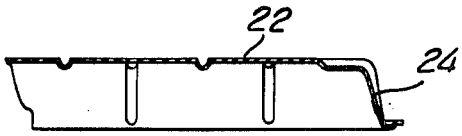
Fig. 2B
Fig. 2C
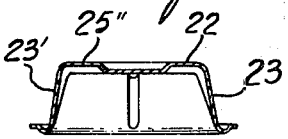
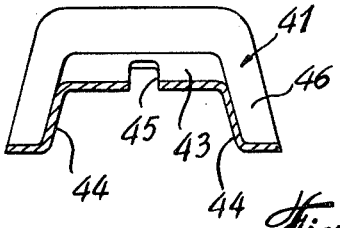
Fig. 4A

FORM PANS FOR CONSTRUCTING RIBBED SLAB STRUCTURES

BACKGROUND OF INVENTION

1. Field of the Invention

The present invention relates to a form pan of the reusable type for use in a form structure.

2. Description of Prior Art

Various types of form pans have been provided for supporting and shaping concrete slab structures, such as, flooring or wall structures. The most popular adapted system is to utilize a form support structure having adjustable posts to support main beams on which a floor, normally constructed of plywood type, lumber or planks, is built to cover the entire area of a floor to be poured. On top of this floor (false work) form pans reinforcement, and concrete is placed. In certain systems, form pans may be used to provide a decorative effect to the ceiling and also too economize on the concrete and reinforcing steel required. In certain structures, the pans are left into the concrete and form a part of the decorative effect and structure of the poured concrete slabs. Other types of pans are utilized for forming only and are removable after the concrete slab has been poured and the concrete has set. The present invention is concerned with this latter type of form pan.

Known form pans of the removable type, are used primarily for shaping concrete surfaces and in most instances, a floor (false work) as above described is required to support the pans and also to provide attachment for the pans. Of the types of form pans known which do not use flooring (false work), the use of a continuous support under the joints of the pans is required, thus constituting a complex support framework which is time consuming to erect and dismantle, making it extremely costly from a labour and material point of view. Still further, when these type forms are removed and in view of the support structure utilized, the concrete surfaces are poorly finished leaving protruding concrete ridges which require further labour to remove or else, the use of additional material to cover up.

The form pan structures heretofore known have many disadvantages, in that some pans require to be assembled individually on the site, or are very difficult to align in a complete system. There are basically two types of pans, and namely, those constructed of metal and those constructed of plastics. The metal ones have the disadvantage of being heavy, difficult to manipulate and install and costly. These type forms are also subject to corrosion. Those constructed of plastics are not sufficiently durable. Also, the known type forms do not interlock with one another, whereby to provide better alignment of the pans on a large surface. Also, known type forms are of short lengths, two to three feet and need complex support structures. Further, these are difficult to remove after concrete has set. Still further, such forms are not easily adaptable in vertical form work.

SUMMARY OF INVENTION

It is a feature of the present invention, to provide a form pan which substantially overcomes all of the above-mentioned disadvantages.

It is a further feature of the present invention to provide a form pan structure having a peripheral flange for interconnection with adjacent form pans.

It is a further feature of the present invention to provide form pans which are self supporting, light in weight, easy to assemble in a framework system, reusable, interstackable, and substantially economical to produce.

It is a further feature of the present invention to provide form pans which may be utilized in horizontal or vertical form structures.

It is a further feature of the present invention to provide form pans which are of long spans whereby being self supporting to permit a reduction in the support frame work required and eliminate the normal flooring that is conventionally required over the support framework. Also, because of their long span sizes, they reduce the number of form units utilized in a form work.

According to the above features, from a broad aspect, the present invention provides a form pan for use in a form structure, said pan comprising a unitary shell having a top wall, opposed elongated side walls and end walls; a peripheral flange formed about a free end of said side and end walls, said flange having a load supporting section and a connection section to permit interlocking with an adjacent pan. The connection section is elevated from the load supporting section in a direction toward the top wall and spaced from the side and end wall for the formation of a recessed joint in a rib of a concrete structure formed between adjacent pans.

According to a further feature of the present invention, there is provided a form structure which comprises a plurality of spaced apart, substantially parallel, support beams held above a surface by support posts. At least two form pans rest on two of the spaced apart support beams in side-by-side relationship. Each of the pans comprises a unitary shell having a top wall, opposed elongated side walls and end walls. A peripheral flange is formed about a free end of the side and end walls. The flange has a load supporting section and a connection section. Pan interconnecting means bridge opposed connection sections of the side-by-side pans and secured thereto to interlock the opposed connection sections together. The connection section is elevated from the load supporting section in a direction toward the top wall and spaced from the side and end wall for the formation of a recessed joint in a rib of a concrete structure formed between adjacent pans. At least a portion of the load supporting section rests on the support beams.

BRIEF DESCRIPTION OF DRAWINGS

The invention will now be described with reference to the accompanying drawings in which:

FIG. 1A is a sectional fragmented view showing a form support structure for forming a concrete ribbed structure and utilizing the form pans of the present invention;

FIG. 1B is a fragmented sectional view showing the recess junction of a concrete ribbed structure, formed with the pans of the present invention;

FIG. 2A is a plan view of a form pan of the present invention;

FIG. 2B is a cross-sectional view along cross-sectional lines 2B—2B of FIG. 2A;

FIG. 2C is a cross-sectional view along cross-sectional lines 2C—2C of FIG. 2A;

FIG. 3 is a detailed view of interlocked peripheral flanges of two adjacent form pans, showing the arrangement of a pan connector;

FIG. 4A is a sectional view of a clamp saddle forming a part of a first type of pan connector;

DESCRIPTION OF PREFERRED EMBODIMENTS

Figure 4B:
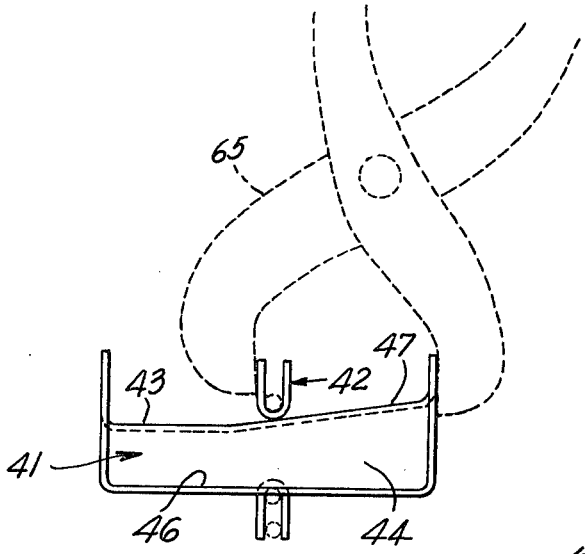
FIG. 4B is a side view of the clamp saddle showing engagement with a locking key.

Referring now to FIG. 1A, there is shown generally at 10, a structure for forming a concrete floor. The structure 10 comprises a plurality of adjustable shore members of support posts 11, normally staggered in spaced apart relationship as is necessary to support the load to be poured on the form pans 12. The form pans 12 are each provided with a shoulder herein a peripheral flange 13, which interlocks with adjacent flanges of adjacent form pans 12. The interlock form pans are supported on spaced apart parallel support beams 14 which are in turn supported by the shore members 11 above a surface 9. Although, as shown in this drawing the support beam 14 lies under and transversely of an end joint 15, the beams 14 could alternatively be extending axially to the long axis of the form pans 12. No other support structure is required other than the support beams 14 and adjustable shore members 11. The pans 12 are interlocked together and at intervals are secured to the beams 14 by driving a nail between a space created between outer edges of the flanges 13. The rib area 20 formed between the form pans 12 is provided with reinforcing steel bars 16, held in a stirrup and bar assembly 17 and interconnecting with the standard type welded wire fabric 18 lying over the entire surface. Concrete 19 is then poured over the surface of the form pans and in the rib area formed therebetween. Alternative reinforcing steel arrangements are possible.

FIG. 1B illustrates the resulting concrete rib 20' formed after the pans 12 have been stripped from the set concrete 19. As herein shown, this results in a recess joint junction 21 formed in the area of the open joint between the end edges of adjacent pans thereby concealing any imperfection or attachment means 26 which may have been set in the concrete to support other finishes over the outer side wall of the concrete form. Thus, there is provided a concrete surface being substantially void of visable imperfections, other than in the recessed joint junction where such imperfections are concealed and allow provision for attachments 26 for suspensions.

Referring now to FIG. 2A, there is shown the structure of the form pan 12 of the present invention. As herein shown the form pan 12 consists of a unitary, elongated, formed shell preferably, although not exclusively, made from plastic material. The form pan 12 defines a top wall 22, elongated side walls 23 and end walls 24. The side and end walls are inclined outwardly from the top wall to the peripheral flange. As shown from FIG. 2A the peripheral flange 13 extends about the entire periphery of the shell. A plurality of stiffening ribs 25 are formed and distributed in the top wall 22, in the elongated side walls 23 and in the end walls 24.

The top ribs 25' extend transversely to the long axis 28 of the form and along a portion only of the width of the top wall 22. The side wall ribs 25'' extend from the outer surface 23' at the bottom of the elongated side wall 23 and angularly inwards along the entire side wall and up the top wall along a portion thereof, see FIG. 2C. The ribs 25''' in the end walls 24 extend in a similar manner to the ribs 25'', see FIG. 2B, but are located in a plane on the central longitudinal axis 28 of the form. All of the ribs are channel type depressions molded integrally with the shell.

The purpose of these ribs is to provide the form pan with sufficient rigidity and to eliminate bulging of the form walls under the weight of the poured concrete 19 and superimposed load required during construction, see FIG. 1A. Also, the specific arrangement of the ribs hereinabove described, also permit the elongated form pans to be utilized as a self supporting long beam having the characteristics of a shell or a folded plate system as is commonly known in the art.

Referring now to FIG. 3, there is shown the exact configuration of the peripheral flange 13 of two pans 12 and the interlocking thereof with the peripheral flange of an adjacent pan 12. The peripheral flange 13 defines a load supporting section 30 and a connection section 31 formed integrally thereof and for the interlocking of adjacent pans. As shown, the connection section 31 is elevated from the load supporting section 30 in a direction toward the top wall of the pan for the formation of a recessed joint 21 (see FIG. 1B) in a rib 20' of a concrete structure, formed between adjacent pans. The connection section 31 defines an end engagement section 32 and a stiffening wall 33 between the sections 32 and 30. As shown, the end engagement section 32 extends in a plane substantially parallel to a plane passing through the load supporting section 30.

A pan interconnecting means 40 interconnects opposed connection sections 31 whereby to permit alignment of adjacent form pans 12 and to prevent displacement thereof, in a formed structure. Herein shown, and with additional reference to FIGS. 4A to 4D, the interconnecting means 40 is constituted by a pan connector comprising a saddle element 41 and an attachment means of key element 42 cooperating therewith for locking engagement of the connection sections of adjacent pans.

As shown in FIGS. 4A and 4B, the saddle element 41 is of substantially U-shape cross-section and defines a bridge wall 43 and opposed tapering side walls 44, formed integral therewith. An aperture 45, herein a slot, is disposed longitudinally in the bridge wall 43. A reinforcing flange 46 is also formed integrally with the outer peripheral edge of the tapering side walls and end edges of the bridge wall. As more clearly shown in FIG. 4B the bridge wall 43 is provided with a slanted wedging outer surface portion 47 for providing a wedging connection with the locking key 42.

Figure 4C:
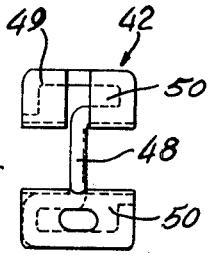
FIG. 4C is a plan view of a locking key utilized with the connector of FIG. 4A.
Figure 4D:
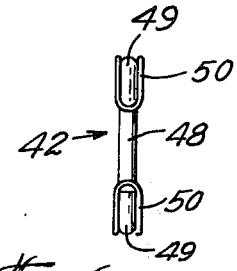
FIG. 4D is an end view of FIG. 4C.

Referring now to FIG. 4C and 4D, there is shown the structure of the key element 42 and it consists essentially of an elongated wire member shaped to define a straight shank portion 48, having transverse engagement ends 49. The transverse engagement ends 49 are formed by bending the wire member in a transverse configuration and covering the member with a U-shape clip 50 to provide smooth engagement inner surface 51 transversely extending relative to the shank portion 48.

Figure 4E:
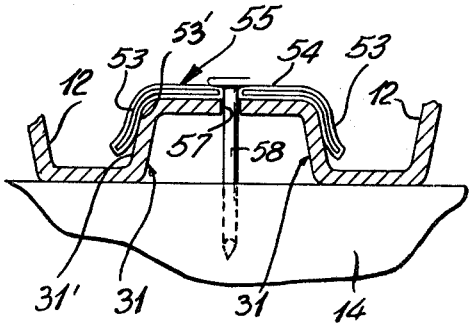
FIG. 4E is a fragmented sectional view illustrating a simplified version of a form connector.
Figure 4F:
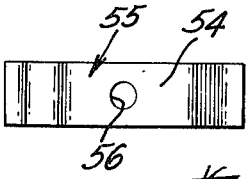
FIG. 4F is a top view of the clamp saddle of FIG. 4E.

A simplified version of a form connector is illustrated in FIGS. 4E and 4F. This form connector is comprised essentially of a flat U-shape clamp 55 having a bridge wall 54 and end arms 53. A hole 56 is disposed centrally of the bridge wall 54. As shown in FIG. 4E, the clamp 55 embraces opposed connection sections 31 of opposed pans 12. With the outside face 31′ of the section 31 in frictional contact with the inner face 53′ of the clamp 55, an open joint 57 is formed between the free ends of the sections 31. This joint permits the passage of an attachment means herein a nail 58 therethrough to secure the pans 12 upon the support beam 14. As shown, the nail 58 is of sufficient length to penetrate the beam 14 to a required depth to prevent movement of the pans and easy removal after concrete has set over them. For metal type support beams nail 58 would be replaced with a bolt type connection.

Referring again to FIG. 3, the pan connector interlocks adjacent connection sections 31 by placing the saddle member 41 over adjacent end connection sections 32 to receive these within the area, between the side walls 44 of the saddle member 41. The end connection sections 32 are of such dimension that when these are received within the area between the side walls 44 and with the stiffening wall 33 in close proximity or frictional connection with the inner face of the side walls 44, a tolerance gap or open joint 60 is maintained between opposed outer end edges 61 of the end connection sections 31 of adjacent pans whereby to permit side passage therethrough of the key member 42. As shown the slot 45 in the saddle member is in alignment with the open joint 60, thus permitting the key element 42 to be positioned as shown in FIG. 3. In this position, the engagement inner surface 51 of the engagement ends 49 of the key element are in frictional contact with the upper face of the saddle member 41 and the under face of the end connection sections 32. In order to provide downward clamping pressure in the saddle member 41 toward the opposed end connection sections 32, the transverse engagement end 49 resting on the top surface of the saddle member 41 is moved upwardly on the wedging surface 47 of the saddle member by suitable means such as the pliers shown in phantom lines at 65 in FIG. 4B by engagement of the outer end edge of the saddle member and the side wall of the transverse engagement end 49 between the jaws of the pliers 65. This movement will cause the clamp to move in a downward direction to rigidly clamp opposed connection sections 31 together in the area of the clamp.

To remove the securement of the clamp 40 after the concrete has set, the support framework is removed from the form structure, and it is only necessary to grasp the lower transverse engagement end 42 of the key under the pans 12 and to turn it to align it axially with the open joint 60, this being possible as the key is constructed of soft metal. Alternatively, the lower transverse engagement end 42 can be twisted in such a way that it will snap from the shank portion 48. Still further, it is within the ambit of the present invention to provide a key member, in which the lower transverse engagement end lies well within the recessed junction 21, whereby it may be utilized as the attachment means 26 as shown in FIG. 1.

Figure 5A:
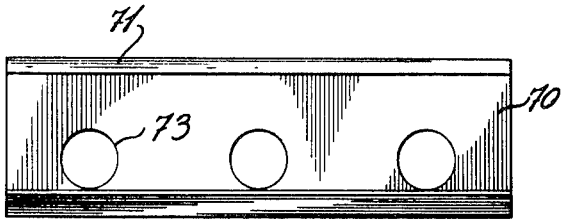
FIG. 5A is a side view of a stripper insert member.
Figure 5B:
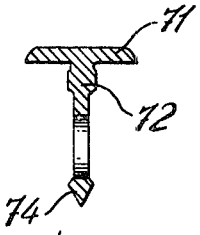
FIG. 5B is an end view of FIG. 5A.

To facilitate the removal of the pans 12, after the concrete has set on the mold structure, a stripper insert member 70, see FIGS. 5A and 5B, may be inserted in some of the open joints 60 at predetermined locations. The stripper insert member 70 is an elongated member of T-shaped cross-section defining a shoulder wall 71 for abutment over opposed free ends or end connection section 32 of the pans, and a transverse engageable wall 72 for extension through the open joint 60. As shown the transverse engageable wall 72 is provided with engageable means, herein, spaced apart apertures 73 throughout its length. This permits a hook member or other type member (not shown) to engage the stripper plate to exert a pulling force thereto, whereby to cause the pan to disengage from the set concrete. Additionally, the free end of the transverse engageable wall 72 may be formed with an enlarged ridge 74, whereby to permit an easy engagement of the insert member by other type tools, such as crow-bars etc.

Figure 6:
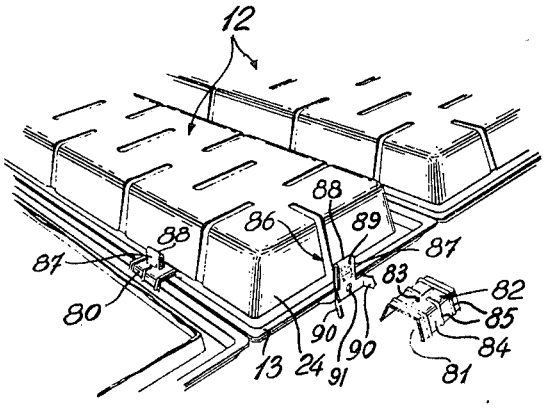
FIG. 6 is a fragmented perspective view showing the arrangement of the form pans of the present invention and their interconnection, a further type of pan connector is herein shown.

Referring now to FIG. 6, there is shown a further construction of a pan connector of the type previously described. The pan connector 80, herein shown comprises a saddle member 81, substantially of the same type as previously described with reference to FIGS. 4A and 4B, but, in the present instance the bridge wall 82 is not provided with a wedging upper surface portion. Also, no reinforcing flange is provided at that peripheral edge of the saddle member and it consists essentially of a U-shape cross-section member with a bridge wall 82 having a longitudinally extending slot 83 therein and tapering side walls 84 integrally formed with the top wall 82. A plurality of stiffening ribs 85 may also be disposed transversely to the long axis of the saddle member 81 to provide reinforcement thereof.

As herein shown, the attachment means is a spring biased key element 86 having juxtaposed walls 87 interconnected at a top end 88 and held in a spring biased spaced apart manner. A plurality of spaced apart transverse protruding ribs 89 are formed in each of the juxtaposed walls 87 and extends outwardly of the surface thereof. Engaging arms 90 are formed at the lower end of the juxtaposed walls 87 for engagement with the under face portion of the end connection section 32 of the peripheral flange 13.

To secure the clamp member 80 in a similar manner as shown in FIG. 3, the juxtaposed walls 88 are pushed through the open joint 60 and within the slot 83 from under the bridge wall 82 of the saddle member 81 until the ribs 89 engage the bridge wall 82 above the outer edge of the slot 83 due to the outward pressure between walls 87 applied by the spring biased arrangement of these walls. Thus, there is formed a positive engagement between the opposed connection sections 31 of opposed pans 12 and the clamp member 80, preventing the pans to displace themselves in their planar position. As shown in FIG. 6 connectors are also secured to the peripheral flange 13 adjacent the end wall 24 of the pans 12. The hole 91 in the lower portion of the juxtaposed walls 87 provide attachment means such as element 26 in FIG. 1B. The pans are removed from the set concrete by bending the arms 90 in axial alignment with the open joint 60. Thus, the clamp member 80 remains in the set concrete concealed in the recess joint 21.

Figure 7:
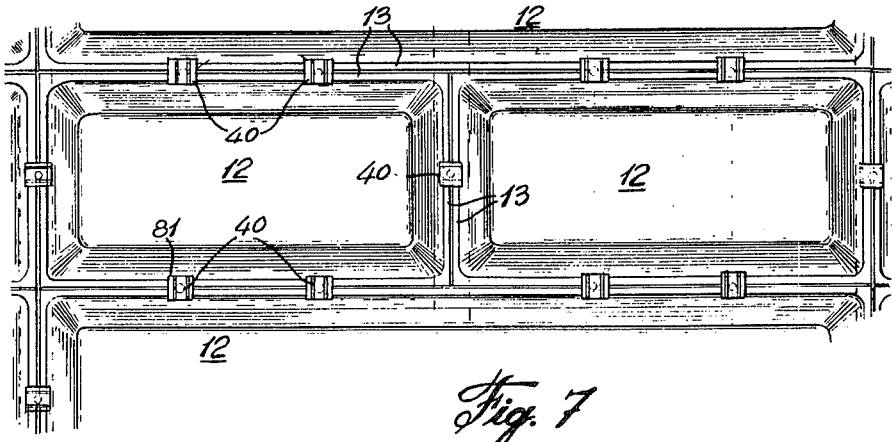
FIG. 7 is a plan view of a staggered arrangement of form pans.

Referring now to FIG. 7, there is shown a plan view of a staggered arrangement of the form pans 12 of the present invention. As herein shown, pans of different lengths may be secured together through the peripheral flanges 13 thus, providing for a rigid interlock pan structure whilst, permitting form work layouts to accommodate vertical form work for the formation of support columns normally required for large floor spans. Also, such staggered arrangement of pans may also be required for accommodating piping, wiring, or other form of duct work, which may be required in the concrete structure.

Figure 8:
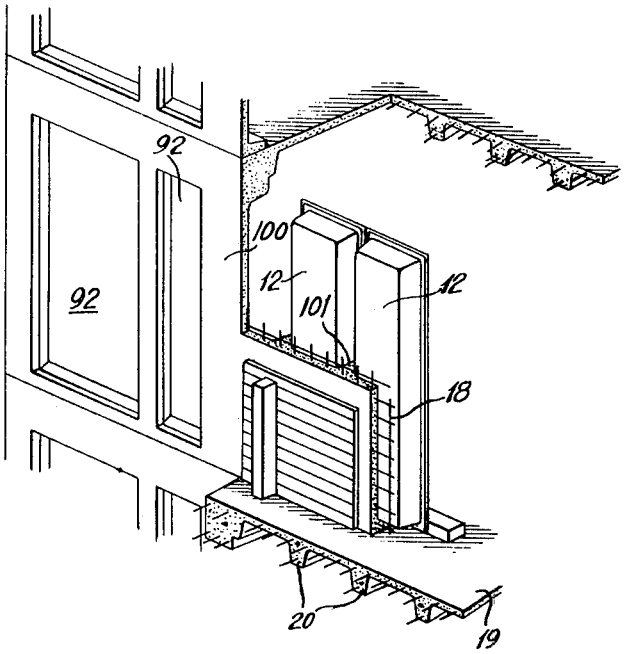
FIG. 8 is a perspective view showing a structure formed with a form pan system utilized in various planes, herein shown as wall and floor structures.
Figure 9:
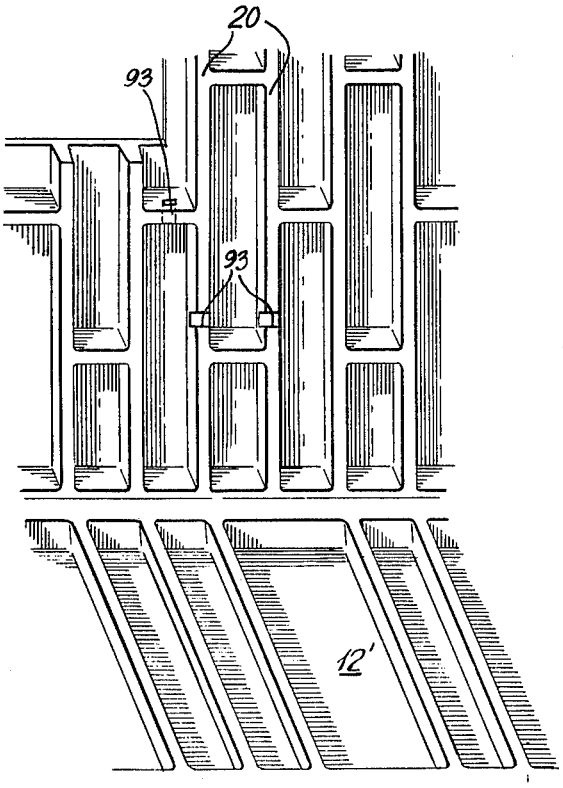
FIG. 9 is a fragmented perspective view of a concrete structure of flooring and wall construction.

FIGS. 8 and 9 are perspective views showing a concrete structure formed with the form pans 12 utilized in various planes herein shown in vertical and horizontal planes. These drawings are provided to illustrate the many applications of the form pans 12 of the present invention. As hereinshown, the form pans 12 may be held in a vertical plane to form vertical concrete rib walls 100 with the ribs 101 extending either internally or externally of the structure. Window or door openings 92 may be provided by closing off sections of the form work around outer side walls of the pans 12 as shown at 12' in FIG. 9. Also, inserts may be held between side walls 23 or 24 to provide channels 93 through ribs 20 in set concrete for passage of conduits for electric wiring, water pipes etc.

Although, the above description relates to a preferred embodiment of the present invention, obvious modifications or utilization of the invention are foreseen and these are intended to be covered by the scope of the appended claims.

We claim:

1. A form pan for use in a form structure, said pan comprising a unitary shell having a top wall, opposed elongated side walls and end walls; a peripheral flange formed about a free end of said side and end walls, said flange having a load supporting section extending outwardly from said side and end walls and a connection section extending from said load supporting section to permit interlocking with an adjacent pan, said connection section is elevated from said load supporting section in a direction toward said top wall and spaced from said side and end walls for the formation of a recessed joint in a rib of a concrete structure formed between adjacent pans.

2. A form pan as claimed in claim 1 wherein said connection section defines an outwardly extending stiffening wall and an end engagement section.

3. A form pan as claimed in claim 2 wherein said end engagement section extends in a plane substantially parallel to a support surface of said load supporting section.

4. A form pan as claimed in claim 1 wherein stiffening ribs are formed in said top wall and elongated side walls, said ribs extending substantially transverse to the longitudinal axis of said pan.

5. A form pan as claimed in claim 4 wherein said ribs in said side walls extend into a portion of said top wall, said ribs in said side walls being equidistantly spaced, said ribs in said top wall extending in a portion of the width of said top wall and equidistantly spaced, each between a pair of transversely opposed ribs in said side walls, the ribs in one side wall being aligned with the ribs in the opposed side wall.

6. A form pan as claimed in claim 5 wherein a reinforcing rib is provided in each said opposed end walls, each said rib in said end walls extending in a portion of said top wall and disposed along the central longitudinal axis of said pan.

7. A form pan as claimed in claim 6 wherein said ribs are molded integral with said unitary shell.

8. A form pan as claimed in claim 7 wherein said unitary shell is molded from plastic material, said ribs being channel-type depressions in the outer surface of said shell on which concrete is to be poured.

9. A form pan as claimed in claim 4 wherein said side walls and end walls are inclined outwardly from said top wall to said peripheral flange.

10. A form structure comprising a plurality of spaced apart, substantially parallel, support beams held above a surface by support posts; at least two form pans in side-by-side relationship resting on two of said spaced apart support beams, each said pans comprising a unitary shell having a top wall, opposed elongated side walls and end walls; a peripheral flange formed about a free end of said side and end walls, said flange having a load supporting section extending outwardly from said side and end walls and a connection section extending from said load supporting section, pan interconnecting means bridging opposed connection sections of said side-by-side pans and secured thereto to interlock said opposed connection sections together, said connection sections being elevated from said load supporting sections in a direction toward said top walls and spaced from said side and end walls for the formation of a recessed joint in a rib of a concrete structure formed between adjacent pans, and at least a portion of said load supporting sections resting on said support beams.

11. A form structure as claimed in claim 10 wherein said connection section is elevated from said load supporting section in a direction toward said top wall, said connection section defining an end engagement section and an intermediate shoulder stiffening wall extending between said load supporting section and said end engagement section, said interconnecting means being a pan connector having a saddle element bridging end portions of opposed connection sections and extending behind said stiffening wall, and attachment means extending through an open joint between the free edge of opposed end engagement sections and engaging said saddle element in clamping engagement over opposed stiffening walls.

12. A form structure as claimed in claim 11 wherein said attachment means is a nail extending through a hole in said saddle element and said open joint and secured into one of said support beams whereby to secure opposed pans together via said one support beam and saddle member.

13. A form structure as claimed in claim 11 wherein said attachment means is a key element comprising an elongated wire having a shank portion and transverse engagement ends spaced apart to apply clamping pressure between opposed end engagement sections and said saddle element.

14. A form structure as claimed in claim 13 wherein said saddle element is of substantially U-shaped cross-section defining a bridge wall, and opposed side walls integral therewith, an aperture in said bridge wall, said opposed end engagement sections and at least a portion of said opposed stiffening walls being received in the area between said bridge wall and opposed side walls when said key element is engaged through said aperture and between opposed connection sections through said open joint.

15. A form structure as claimed in claim 14 wherein said saddle element bridge wall has a slanted wedging outer surface, said aperture being a slot to permit side passage of one of said engagement ends therethrough, an outer one of said engagement ends being in frictional contact with a portion of the end engagement section of said opposed connection sections, when said one engagement end is in tight frictional engagement with said wedging outer surface.

16. A form structure as claimed in claim 10 wherein said connection section defines an end engagement section and an intermediate stiffening wall extending between said load supporting section and said end engagement section, the connection sections of opposed load supporting sections defining a recess joint junction for a concrete structure formed on said form structure, whereby joint imperfections are recessed from a finish surface of said concrete structure.

17. A form structure as claimed in claim 16 wherein said pan interconnecting means provide a plurality of connectors secured in said recess joint junction between opposed free ends of said opposed connection sections, said connectors being concealed in said recess joint junction.

18. A form structure as claimed in claim 10 wherein an open joint is formed between opposed free ends of said opposed connection sections, and including a stripper insert member of T-shape cross-section having a shoulder wall in abutment over opposed free ends of said connection section and a transverse engageable wall extending through said open joint to permit removal of said pans when a concrete structure is set on said form structure.

19. A form structure as claimed in claim 18 wherein said transverse engageable wall is provided with engageable means for engagement by a stripper insert removal tool.

20. A form structure as claimed in claim 10 wherein stiffening ribs are formed in said top wall and elongated side walls, said ribs extending substantially transverse to the longitudinal axis of said pan said ribs providing rigidity to the form under imposed loads.

* * * * *